United States Patent [19]

DuRocher

[11] 4,295,699

[45] Oct. 20, 1981

[54] PRESSURE SENSITIVE COMBINATION SWITCH AND CIRCUIT BREAKER CONSTRUCTION

[75] Inventor: Gideon A. DuRocher, Mt. Clemens, Mich.

[73] Assignee: Essex International, Inc., Fort Wayne, Ind.

[21] Appl. No.: 472,582

[22] Filed: May 22, 1974

Related U.S. Application Data

[63] Continuation of Ser. No. 857,941, Sep. 15, 1969, abandoned.

[51] Int. Cl.[3] ..... H01R 13/24

[52] U.S. Cl. ..... 339/61 M; 338/99; 339/DIG. 3

[58] Field of Search ..... 338/99, 100, 112, 114; 339/DIG. 3, 59, 61 M; 252/511, 512, 514; 269/104

[56] References Cited

U.S. PATENT DOCUMENTS

| | | | |
|---|---|---|---|
| 740,787 | 10/1903 | Vetter | 338/114 |
| 2,596,420 | 5/1952 | McGarvey | 339/DIG. 3 |
| 2,734,978 | 2/1956 | Bulgin | 338/114 |
| 3,056,750 | 10/1962 | Pass | 252/512 |
| 3,194,860 | 7/1965 | Ehrreich et al. | 252/511 |
| 3,509,296 | 4/1970 | Harshman et al. | 338/99 |

FOREIGN PATENT DOCUMENTS

| | | | |
|---|---|---|---|
| 1059186 | 2/1967 | United Kingdom | 338/99 |

*Primary Examiner*—Howard N. Goldberg
*Assistant Examiner*—Eugene F. Desmond
*Attorney, Agent, or Firm*—Learman & McCulloch

[57] ABSTRACT

A pressure sensitive switch and circuit breaker comprising a body formed of a resilient, deformable inorganic insulating material such as silicone rubber having dispersed therethrough, including its outer surface, a quantity of electrically conductive discrete metal particles. The particles are so oriented in the body of insulating material when the latter is in its normal, unstressed condition that the body is non-conductive, but the particles are movable relatively to one another in response to the application of a compressive force on the body so as to effect engagement of a sufficient number of particles to establish a conductive path through the body. The resilience of the body material enables it to return to its normal condition following release of the compressive force, thereby effecting relative movement of the particles out of engagement with one another and restoring the body to its non-conductive state. Should the switch be subjected to an overload current the engaged particles may be consumed, thereby rendering the switch non-conductive and protecting the other parts of the circuit. Upon correction of the cause of the overload the switch once again may be rendered conductive by subjecting it to compressive force.

19 Claims, 20 Drawing Figures

A pressure sensitive switch and circuit breaker constructed in accordance with the invention comprises essentially a composite body or pad formed of a synthetic, inorganic, resilient, non-conductive substance such as silicone rubber and throughout which is dispersed a quantity of discrete, electrically conductive, metallic particles. The dispersion of the particles is such that when the pad is in its normal, unstressed condition the electrical resistance of the pad is infinite and the pad is non-conductive. When the pad is subjected to compressive force of sufficient magnitude, however, the particles are forced to move relatively to one another into particle-to-particle engagement. The resistance of the pad changes to that of the metal particles and the pad becomes electrically conductive. Upon release of the compressive force, the inherent resilience of the pad restores it to its normal, unstressed condition whereupon the particles again move relatively to one another, but in this instance in such manner as to disengage one another and render the pad non-conductive. The change from conductive to non-conductive and vice versa occurs rapidly, as is the case with a conventional switch of the snap action type.

The number of particles which move into particle-to-particle engagement may vary according to the force applied to the body, and it is not essential that all of the particles engage one another. It is only necessary that a train of particles be in engagement between the other current conductors of a circuit so as to establish a conductive path through the body. In fact, it is preferred that not all of the particles in the body engage one another. In such a case, one train of engaged particles may be consumed by an overload current, thereby rendering the body non-conductive. Other particles, however, will be unaffected thereby making it possible for such other particles to form additional trains for current conduction.

A device constructed according to the invention has many desirable advantageous characteristics not normally associated with conventional switches and in addition to its circuit protecting capabilities. For example, problems associated with the pitting or erosion of the contacts of a conventional switch virtually are overcome. This is because there are so many possible current conductive paths through the pad, due to the large number of metal particles and the large number of possible arrangements of such particles, that any pitting of particles which may occur is of no consequence over the normal life expectancy of the switch. Moreover, any arcing which does occur between particles is confined to the interior of the pad, thereby making the switch ideally suited for use in environments requiring explosion proof switches.

Another advantage of devices of the kind disclosed herein is the ease with which they may be varied to conform to differing operating requirements. Generally, the compressive force required to render the switch conductive will be directly proportional to the thickness of the pad. A given sample of the composite body or pad, therefore, can be made responsive to extremely light pressures or responsive to relatively heavy pressures, depending on the thickness of the pad. The sensitivity of a switch also is related to the quantity and size of the conductive particles, the force required to render a pad conductive varying inversely according to the quantity of particles contained within the pad and varying directly according to the size of such particles. It is possible, therefore, to manufacture devices having greatly differing operating characteristics.

A further important advantage of switch devices constructed according to the invention is that they may be utilized in practically all environments where switching or circuit protection is desired. That is, the device may be used to couple rigid printed circuit components, flexible printed circuit components, conventional rigid terminal components, wires without terminals, or any combination thereof. In fact, the switch device of the invention may be, in effect, a printed circuit.

The material from which the device is made should be resilient at both low and high temperatures, readily moldable, stable at high temperatures, porous or non-porous, resistant to ozone, oil and arcing, inorganic, durable, low in carbon content, and have high dielectric strength. Certain kinds of silicone rubber possess all of these properties. Silicone rubbers are prepared by milling together a dimethyl silicone polymer, an inorganic filler, and a vulcanizer or catalyst. Many different fillers may be used, such as titania, zinc oxide, iron oxide, silica, and the like. The type and amount of filler used alters the chemical, physical and electrical properties. It is possible, therefore, to produce many different kinds of silicone rubbers which have the properties referred to above. Many varieties of silicone rubbers exist which perform satisfactorily. For example, good results have been obtained with silicone rubbers formed by combining resins 850 and 3120 (Dow Corning Corporation, Midland, Michigan) with the manufacturer's recommended S or F catalyst or vulcanizer which includes as its active ingredient such compounds ad dibutyl tin dilaurate or stannous octoate. Satisfactory results also have been obtained with silicone rubbers formed by combining RTV-7 resin (General Electric Company, Schenectady, New York) with the manufacturer's Nuocure 28 vulcanizer. Metallic particles are stirred into the resin-catalyst substance in sufficient quantity to be dispersed substantially uniformly throughout the mass. The mixture then is poured into a mold and cured in the manner prescribed for the particular resin. The mold may be any desired shape to produce a composite, solid body composed of the silicone rubber and the metal particles, the latter being dispersed throughout the body, including its outer surface.

The metal particles should be formed of a metal that has excellent conductive properties and also should be one which, if it oxidizes, has an electrically conductive oxide. Particles made from noble metals, such as silver and gold, have the desired inherent conductivity and normally form conductive oxides, but particles composed entirely of noble metal are quite expensive. There are available, however, discrete spherical metal particles composed of base metals, such as copper, iron and the like, coated with silver and which act very much like solid silver particles, but which are less expensive. The size of the particles may vary from 0.05 mil to 100 mils. Excellent results have been obtained utilizing particles in the 3–8 mil range.

A switch-circuit breaker device constructed in accordance with the embodiment disclosed in FIGS. 1–3 is designated generally by the reference character 1 and comprises a disc-shaped body 2 formed of silicone rubber and throughout which is dispersed a large quantity of discrete, substantially uniform size, electrically conductive particles 3. The particles 3 preferably are spherical, silver coated, copper particles of substantially uni-

PRESSURE SENSITIVE COMBINATION SWITCH AND CIRCUIT BREAKER CONSTRUCTION

This is a continuation, of application Ser. No. 857,941, filed in the U.S. Patent Office on Sept. 15, 1969 now abandoned.

The invention disclosed herein relates to a combined switch and circuit breaker and more particularly to a pressure sensitive device which is rendered conductive and non-conductive in response to the application and release, respectively, of compressive force on a resilient body of insulating material throughout which is dispersed a quantity of discrete, electrically conductive particles. The resilient material preferably constitutes an inorganic material of the silicone family and the conductive particles preferably are formed from a base metal coated with a noble metal which is unaffected electrically by oxidation.

Current controlling switches operable in response to changes in pressure have multiple applications in the electrical art and have been proposed heretofore. Not all of the known pressure sensitive switches are altogether satisfactory, however, for a number of reasons. For example, some of the known switches utilize organic plastic pads containing electrically conductive fiber-like elements. Such switches rely upon oxidation of the conductive elements to prevent conduction and require the application of considerable force to break down the oxide film in converting the switch from non-conductive to conductive condition. As a result, such switches may not be as sensitive as may be required. Further, organic plastic foams are incapable of withstanding the high temperatures of some environments in which such switches otherwise might be used. Moreover, not all foam substances are moisture proof, thereby rendering such switches subject to deterioration or unreliable operation in high moisture environments.

Others of the known pressure sensitive switches have other undesirable characteristics. For example, the current capable of being handled by many such switches is so small as to require the use of one or more relays in the circuits to be controlled by the switches. This represents an additional, undesirable expense. In those instances in which a pressure sensitive switch is capable of handling sufficiently large currents to avoid the necessity of relays, the internal resistance of such switch may increase in direct proportion to the pressure to which it is subjected, thereby resulting in the generation of undesirable heat and necessitating the use of heat dissipating means.

None of the known pressure sensitive switches is capable of performing the dual functions of switching and circuit protection. Instead circuits employing known pressure sensitive switches also utilize fuses or circuit breakers, or both, in addition to the switches.

An object of this invention is to provide a pressure sensitive switch which selectively is extremely sensitive or relatively insensitive to small changes in pressure and which may be constructed in such manner as to be capable of conversion from conductive to non-conductive condition, and vice versa, substantially instantaneously in response to the application and release of a force of a predetermined magnitude.

Another object of the invention is to provide a pressure sensitive switch which not only performs a switching function, but also performs a circuit protecting function.

Another object of the invention is to provide a pressure sensitive switch which is convertible from one having infinite resistance to one having substantially no resistance, and vice versa, solely in response to changes in pressure to which the switch is subjected.

A further object of the invention is to provide a switch of the kind referred to which is capable of withstanding high temperatures without adverse effects and which is moisture proof.

Another object of the invention is to provide a pressure sensitive switch which has ample current handling capabilities and which has utility in an exceedingly large range of applications.

Other objects and advantages of the invention will be pointed out specifically or will become apparent from the following description when it is considered in conjunction with the appended claims and the accompanying drawings in which:

Figure 13:
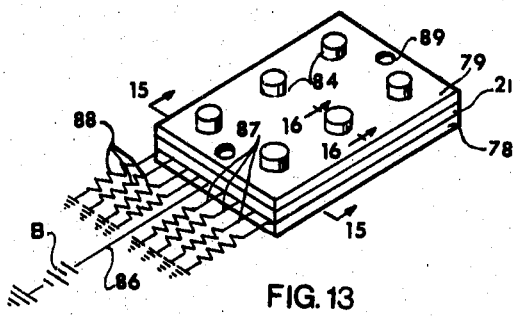
FIG. 13 is an isometric view of a multiple contact switching device.
Figure 14:
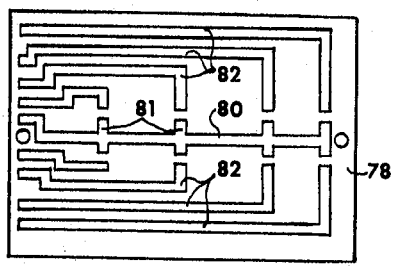
FIG. 14 is a top plan view of a part of the apparatus shown in FIG. 13.
Figure 15:
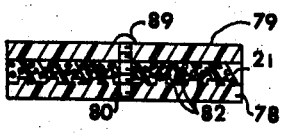
Figure 16:
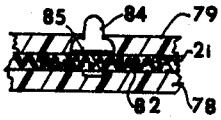
Figure 17:
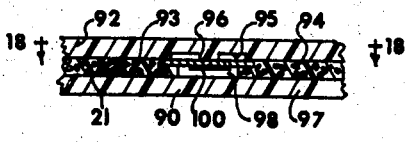
Figure 18:
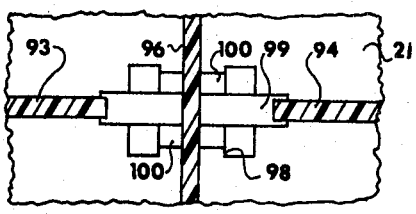
Figure 19:
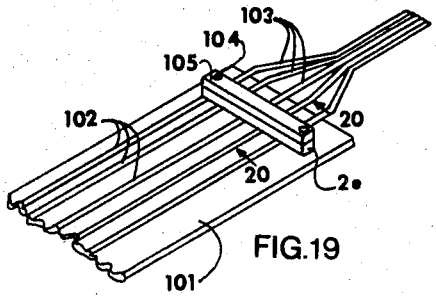

FIGS. 15 and 16 are sectional views taken on the lines 15—15 and 16—16, respectively, of FIG. 13;

FIG. 17 is a sectional view of a modified switching device;

FIG. 18 is a sectional view taken on the line 18—18 of FIG. 17;

FIG. 19 is an isometric view of another embodiment of the invention; and

Figure 20:
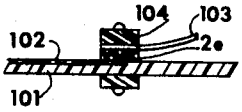

FIG. 20 is a sectional view taken on the line 20—20 of FIG. 19.

form size and the dispersion of the particles is substantially uniform throughout the body, including its outer surfaces. A typical body 2 may have a silicone resin to catalyst ratio of 5 to 1 by weight and a particle to silicone ratio of 3.5 to 1 by weight. The body may be of any diameter, such as 0.625 inch and of any desired thickness, such as 0.060 inch. The upper and lower surfaces of the body 2 may be flat or ribbed, as illustrated at 4, or one surface may be flat and the other surface ribbed. Ribbing of the surface increases the sensitivity of the switch.

Silicone rubber has little resistance to shearing and abrading forces. This may be compensated for by bonding electrically conductive discs 5 and 6 to the opposite surfaces of the body 2 by means of commercially available, conductive, epoxy cement. The discs 5 and 6 also constitute force applying means for applying compressive forces on the body.

The device 1 may be incorporated in an electric circuit comprising a battery B or other energy source and to the opposite terminals of which are connected leads 7 and 8 which, in turn, are joined to the conductive plates 5 and 6. An electrically operable device, such as a lamp 9, may be incorporated in the circuit.

Figure 1:
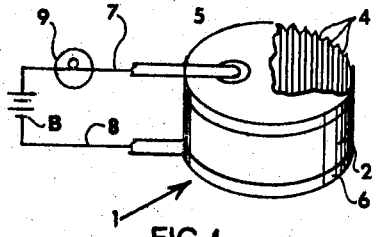
FIG. 1 is isometric, partly fragmentary view of a switch constructed in accordance with the invention and illustrating schematically a simplified electrical circuit of which the switch is a part.
Figure 2:
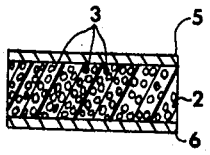
FIG. 2 is a transverse sectional view through the switch and illustrating it in its normal, unstressed condition.
Figure 3:
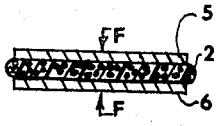
FIG. 3 is a view similar to FIG. 2, but illustrating the switch subjected to compressive force.

The electrically conductive particles 3 are so oriented in the body 2 that, when the latter is in its normal, unstressed condition as shown in FIGS. 1 and 2, no electrically conductive path exists through the body 2 between the members 5 and 6. Stated differently, when the body is in its normal, unstressed condition, the metallic particles 3 are not in particle-to-particle engagement from one surface of the body to the other. When a sample of the body 2 is viewed under a microscope, the silicone rubber appears to encapsulate each metallic particle and isolate it from the others, but the rubber does not adhere to the particles. When the body is subjected to compressive forces F and deformed or compressed, as is indicated in FIG. 3, the metallic particles are forced to move relatively to one another and to the encapsulating rubber in such manner that a sufficient number of the particles move into engagement with one another to establish a conductive train or path from one of the plates 5 or 6 to the the other. Current then may flow from the battery B through the circuit and illuminate the lamp 9. The low shear resistance of silicone rubber and the non-adherence of the rubber to the particles facilitate the movement of the particles. The resistance of the body 2, when the switch is conductive, corresponds substantially to the resistance of the metal particles. Since the electrical resistance of noble metals, such as silver, is quite low, the resistance of the switch also is quite low and, therefore, permits the switch to accommodate a high value current. For example, a switch having a body constructed of Dow Corning 3120 silicone rubber and containing 3 mil, silver coated copper particles in the ratio referred to above and having a thickness of 0.06 inch was sandwiched between conventional terminals and was capable of conducting a current of 40 amperes without impairment. Another, similar switch was incorporated in a 115 volt AC circuit including a 25 watt electric lamp bulb and was cycled at the rate of 130 cycles per minute. After more than seven million cycles of operation, the switch still functioned perfectly.

It is believed that, when a conductive path is established through the body 2, the current density of such path between the other circuit components is much less than that of the point-to-point contact of conventional metal-to-metal connectors. The resistance of the body 2, when conductive, has been measured to be 0.0025 ohms which is equivalent to the resistance of 4.7 inches of 18 guage wire or 3 inches of 20 guage wire.

When the compressive force applied to the body 2 is released, the inherent resilience of the silicone rubber causes the latter to expand and assume its normal, unstressed condition, whereupon the engaged conductive particles are forced to move out of engagement, thereby disestablishing or breaking the conductive path through the body 2. If there should by any arcing between particles as they separate from one another, the arcing will be confined to the interior of the body 2. Even though the presence of an arc may destroy or impair the current conductive capacity of the particles between which the arc forms, there are so many particles in the body and, consequently, so many possible current conductive paths, that a potential path always exists through the body throughout the life expectancy of the switch. The presence of arcs within the body 2 leaves a track, but because of the low carbon content of the silicone rubber the arcing track is composed of non-conductive inorganic matter, rather than a conductive carbon track such as would be left in organic materials.

The pressure to which the switch 1 must be subjected to render it conductive depends upon the force applied, the area of the body, the thickness of the body and the quantity and size of the conductive particles. The thicker the body and the larger the size of the particles, the greater the applied force must be to render the body conductive. Conversely, the thinner the body and the smaller the size of the particles, the lesser the applied force must be to render the body conductive. Consequently, switches having greatly varying sensitivities can be constructed, but in each instance the switch undergoes a sharp transition from infinite resistance to a resistance of 0.1 ohm or less when subjected to the required compressive pressures. Switches having solid bodies 2 have been constructed which are rendered conductive when subjected to pressures as low as a few ounces per square inch, and other similar switches have been constructed which are rendered conductive when subjected to pressures as high as 180 p.s.i.

If the body 2 is compressed so as to establish a conductive path between the members 5 and 6, the number of particles that move into engagement to establish the conductive train will be less than all of the particles. It is believed that a specific conductive train or path through the body will be established because of some slight irregularity in thickness of the body or because of a higher concentration of particles at that path, or both.

If, when a current path is established through the body, the circuit is subjected to excessive or overload current, such as by a short circuit, the engaged particles will be subjected to the overload and several of the engaged particles of the train will be destroyed. It is believed that those particles nearest the plates 5 and 6 will be consumed or decomposed. The heat accompanying the destruction of the particles will char the silicone rubber, thereby producing a non-conductive arc track. The current conductive path through the body 2 thus no longer will exist and the circuit will be broken. In effect, therefore, the body 2 has become a circuit breaker.

After the current path through the body 2 is destroyed, the body may remain non-conductive or return to conductivity automatically. The action taken by the body depends on several factors. If the compressive force applied to the body 2 is relatively light, but sufficiently great to establish conduction initially, the consumption of one or more particles of the engaged train by an overload current will render the body non-conductive. The body may be rendered conductive manually, however, by increasing the force applied to the body, or by relieving the force applied to the body followed by a reapplication of the same or greater force. In either instance a fresh train of engaged particles is established through the body.

If the pressure applied to the body is considerably more than that necessary to establish initial conduction, a relatively large number of particles will be engaged so as to provide a train of engaged particles through the body, but not all of the engaged particles will conduct the current. The consumption of some of the particles by an overload current will make it possible for some of the other particles to move into the spaces created by the consumption of particles. Thus, the body again may be rendered conductive automatically until such time as the number of particles shiftable into the spaces under the applied force is exhausted. Thereafter, and if the body is to continue to function, additional force will have to be applied to the body in the manner aforesaid.

If the force to which the body is subjected is such that the conductivety of the body is borderline, but conductive, the passage of a current higher than desired through the body will generate heat which is not sufficient to consume any particles, but which is sufficient to cause expansion of the silicone rubber and the metal particles according to their coefficients of expansion. The expansion of the silicone rubber is much greater than that of the particles and may result in the formation of a gap between adjacent particles, thereby breaking the circuit through the body. Upon breaking of the circuit the heat will be reduced, thereby causing the silicone rubber to contract and reestablish engagement between the particles whereupon the body again becomes conductive. In effect, therefore, the body constitutes a self resetting circuit breaker.

Figure 4:
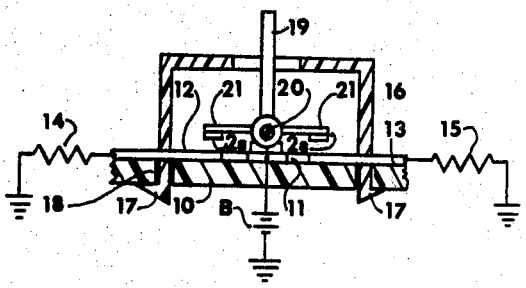
FIG. 4 is a sectional view of a typical printed circuit construction incorporating switches according to the invention and illustrating one type of switch operating means.

Devices constructed in accordance with the invention have wide applications, some of which are disclosed in FIGS. 4–20. FIG. 4 illustrates a printed circuit comprising a substrate or board 10 of insulating material carrying coplaner, spaced, electrical conductors 11, 12 and 13. The conductor 11 may be connected to a battery B and the conductors 12 and 13 may be connected to electrical devices 14 and 15, respectively, to be operated. Mounted on the board 10 is an open bottom casing 16 having barbed lugs 17 which pass through openings 18 in the board 10. A rockable operating lever 19 is pivoted as at 20 to the casing and bears against and compresses a body *2a* mounted on the conductor 11 and corresponding to the body 2. The operating member includes a pair of conductive, force applying arms 21 on each of which is secured a similar body *2a*. When the operating member 19 is rocked counterclockwise from the position shown in FIG. 4, the left hand body *2a* engages the conductor 12 and is compressed, thereby establishing a circuit from the battery B through the conductor 11, the switch body *2a*, the left arm 21, the associated switch body *2b*, and the conductor 12 to the device 14. When the rocking force applied to the operating member 19 is released, the resilience of the pad *2b* will restore the operating member to its original position. Rocking of the operating member 19 in the opposite direction will establish a circuit from the battery B to the device 15 through the right arm 21 and the associated pad *2a*.

Figure 5:
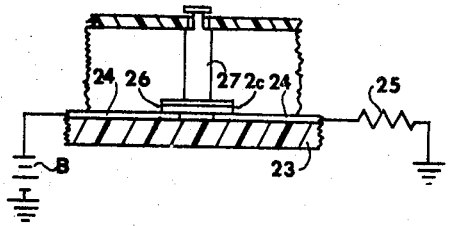
FIG. 5 is a view of another printed circuit and a touch type switch operator.

FIG. 5 discloses a touch switch for a printed circuit comprising an insulating board 23 on which is carried spaced apart coplanar conductors 24, one of which is connected to a battery B and the other of which is connected to an electrical device 25 to be operated. The space between the conductors 24 is spanned by a switch body *2c* similar to the body 2 and is located directly beneath the conductive foot 26 of a reciprocable force applying plunger 27 mounted in a casing 28. When the plunger 27 is depressed, the switch body *2c* is compressed between the foot 26 and the conductors 24, thereby establishing a conductive path between the conductors 24 via the switch body *2c* and the conductive foot 26. Upon release of the force applied to the plunger 27, the resilience of the body *2c* will restore the plunger to its projected position, relieving the compressive force on the body *2c* and rendering the latter non-conductive.

Figure 6:
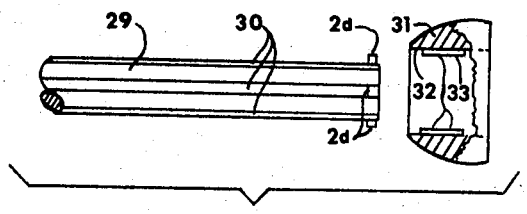
FIG. 6 is a fragmentary, exploded view of another application for switches according to the invention.

FIG. 6 discloses a tube 29 on which ribbon-like conductors 30 have been sprayed. At one end of the tube 29 a conductive body *2d* similar to the body 2 is bonded to each of the conductors 30. A coupling 31 having a bore 32 provided with conductors 33 is adapted to accommodate the one end of the tube 29 with the conductors 33 overlapping the conductors 30. The size of the bore 32 is such that, when the coupling 31 is fitted to the tube 29, the switch bodies *2d* are wedged between the conductors 30 and 33 and compressed and rendered conductive, thereby establishing circuit continuity between the conductors 30 and 33. It will be understood that the conductors 30 will be connected to a battery or the like and the conductors 33 will be connected to electrical devices to be operated.

Figure 7:
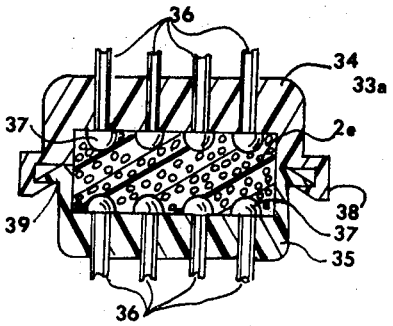
FIG. 7 is a sectional view of a disconnect or releasable coupling device incorporating a switch according to the invention.

It is not essential that the switching bodies *2d* be individual, separate members. Instead, the individual bodies *2d* could be replaced by a strip which spans all of the conductors 30. When the coupling 31 then is fitted to the cube 29, those portions of the strip in engagement with the conductors 30 will be compressed and rendered conductive, but the portions of the strip between adjacent conductors will not be compressed and, therefore, such portions will be non-conductive. This characteristic of the apparatus is illustrated in FIG. 7 wherein an insulating casing 33 is composed of two halves 34 and 35, each of which has a plurality of electrically conductive members 36 secured thereto. Each member 36 has a force applying projection or head 37 which is aligned with but spaced from a companion head 37 when the casing halves 34 and 35 are assembled with one another. The casing halves are maintained in assembled relation by hooked lugs 38 on the casing half 34 which engage flanges 39 on the member 35. Interposed between the casing halves 34 and 35 is an elongate strip or body *2e* similar to the body 2. The pad *2e* of such thickness that, when the casing halves are assembled, the confronting projections 37 of each pair of axially aligned members 36 compress the adjacent zones of the pad *2e* and render the latter conductive in the compressed zones. Between the confronting projections 37, however, the body *2e* is relatively uncompressed and remains non-conductive.

The construction shown in FIG. 7 is particularly well adapted for use in lieu of pin and socket type coupling devices which are troublesome in manufacture and use due to the necessity of quite precise alignment between pins and their respective sockets. In addition, the area of contact between the compressed pad and the conductors 37 is considerably larger than the point-to-point contact which often results between abutting conductors.

Figure 8:
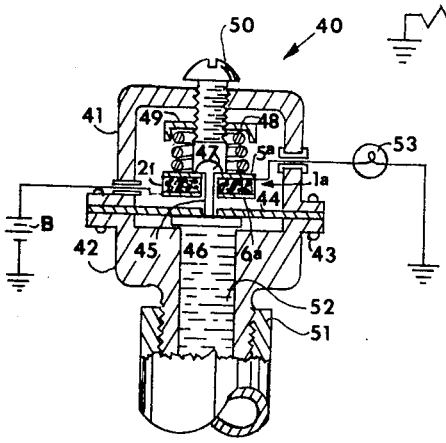
FIG. 8 is a sectional view through a fluid pressure indicating device and incorporating a switch according to the invention.

FIG. 8 illustrates the use of a pressure sensitive switch according to the invention in a fluid pressure sensing device such as an oil pressure indicator actuating mechanism 40. The actuator 40 comprises a pair of body members 41 and 42 secured together by screws 43 and between which is interposed a diaphragm 44. Extending through the diaphragm and through a seal (not shown) is a plunger 45 which has at one end a disc 46 and at the other end a head 47. Surrounding the plunger 45 is a pressure sensitive switch 1*a* having a body 2*f* like the body 2 sandwiched between discs 5*a* and 6*a*. The parts 5*a*, 6*a* and 2*f* are provided with central bores in which the plunger 45 is accommodated. The head 47 of the plunger is fixed to the disc 5*a*. Bearing against the disc 5*a* is one end of a spring 48, the opposite end of which seats on a plate 49 that is vertically adjustable by means of a screw 50. The body 42 may be threaded into an oil line 51 and is provided with a bore 52 which permits fluid to displace the disc 46. The disc 6*a* is connected to a battery B and the disc 5*a* is connected to a warning lamp 53 that is adapted to be illuminated when the pressure of the fluid falls below a predetermined level.

In the operation of the apparatus 40, the pressure of the fluid in the line 51 normally is such as to maintain the plunger 45 in an upwardly displaced condition, as shown in FIG. 8. In this position of the plunger the body 2*f* of the switch 1*a* is in its unstressed condition and is not conductive. Should the pressure of the fluid decrease so as to enable the plunger 45 to move downwardly from the position shown in FIG. 8, the spring 48 will seat the switch 1*a* on the diaphragm and subject the switch to a compressive force sufficient to render it conductive, whereupon the lamp 53 will be illuminated.

Figure 9:
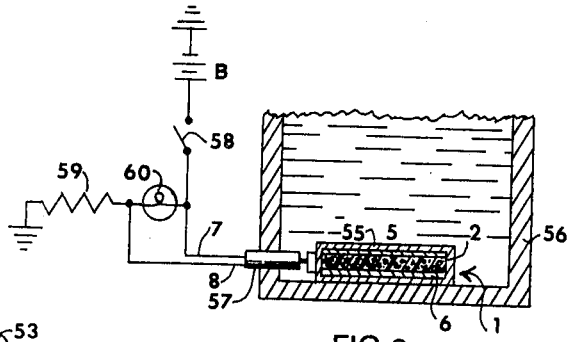
FIG. 9 is a sectional view of a liquid container including a switch according to the invention and adapted to indicate a low level of fluid in the container.

FIG. 9 illustrates the switch 1 as part of a low liquid level indicating system. The switch 1 is enclosed within a flexible neoprene or the like envelope 55 and is located at the bottom of a fuel or other tank 56. The leads 7 and 8 from the discs 5 and 6 extend through a fitting 57, one lead being connected to a battery B via a switch 58, such as a vehicle's ignition switch. The other lead is grounded via a resistor 59. Bridging the leads 7 and 8 is an electric indicating lamp 60. When the switch 58 is closed and the level of fluid in the tank 56 is above a predetermined minimum, the head of the fluid in the tank maintains the switch 1 in a compressed, conductive condition, thereby shorting out the lamp 60. When the level of fluid falls to a predetermined level, however, the compressive force applied to the switch 1 by the head of liquid is insufficient to maintain the switch conductive. Consequently, the lamp 60 will be illuminated so as to provide a warning of the low liquid level.

Figure 10:
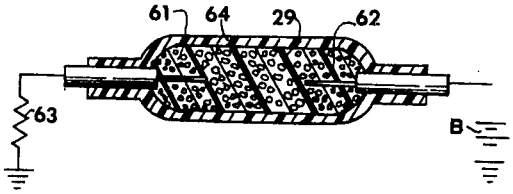
FIG. 10 is a cross sectional view of a pressure sensitive switch according to the invention contained within a flexible or shrinkable enclosure.

FIG. 10 illustrates an embodiment of the switch which is particularly adapted for use as a squeeze switch or as a high temperature alarm switch. In this embodiment a pair of electrically conductive wires 61 and 62 are maintained in axially spaced apart, preferably aligned condition so as normally to be incapable of conducting a current. One of the wires may be connected to a battery B and the other of the wires 52 may be connected to an electrically operable signal 63. Joined to and surrounding the wires 61 and 62 is a flexible envelope 64. Filling the envelope 64 is a body 2*g* similar to the body 2, with the exception that the body 2*g* is shredded, rather than in solid form. The body 2*g* may be made by simply shredding the body 2. When the envelope 64 is squeezed, the body 2*g* is compressed so as to render it conductive and capable of establishing a conductive path between the wires 61 and 62. If desired, the envelope 64 may be formed of a known heat sensitive material which shrinks when subjected to an elevated, predetermined temperature. In this instance the switch 61 effectively may be used in conjunction with a fire alarm signal inasmuch as elevated temperatures caused by a fire will result in shrinkage of the envelope 65 and consequently compression of the body 2*g* to complete a circuit between the wires 62 and 63. The force required to render the body 2*g* conductive is substantially less than that required to render the solid body 2 conductive.

Figure 11:
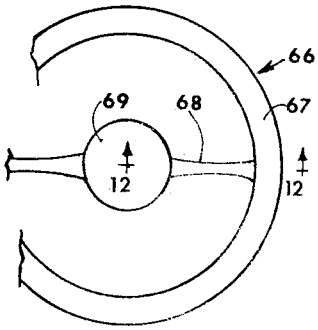
FIG. 11 is a fragmentary view of a typical vehicle steering wheel provided with a horn control switch constructed according to the invention.
Figure 12:
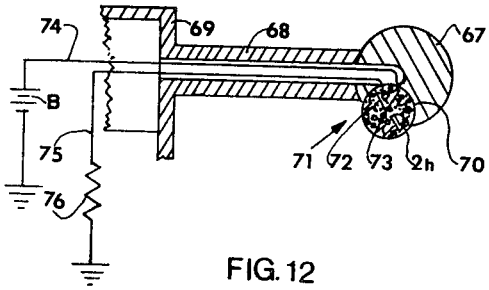
FIG. 12 is an enlarged, sectional view taken on the line 12—12 of FIG. 11.

FIGS. 11 and 12 illustrate a switch constructed according to the present invention and utilized in conjunction with a vehicle's steering wheel 66 to enable operation of the vehicle's horn. The steering wheel has a rim 67 joined by spokes 68 to a centrally located housing 69 that is adapted to be mounted for rotation on the vehicle's steering column (not shown). The rim 67 is provided with an endless groove 70 within which is mounted a switch 71 comprising an endless body 2*h* similar to the body 2 and within which is embedded a pair of endless, spaced apart conductive wires 72 and 73. Leads 74 and 75 are connected to the wires 72 and 73 for connecting the latter respectively to a battery B and to a horn 76. A portion of the body 2*h* protrudes from the wheel rim 67 to provide force applying means.

The horn may be operated by the vehicle driver's compressing the body 2*h* at any desired zone along its length, whereupon the compressed body will be rendered conductive and establish a circuit between the wires 72 and 73, thereby connecting the horn to the battery. The wires 72 and 73 are not moved into engagement with one another.

In FIGS. 13–16 there is disclosed the equivalent of a printed circuit comprising a base 78 formed of insulating material, a cover block 79 also of insulating material, and a pad or body 2*i* similar to the body 2 sandwiched therebetween. The inner surface of the base is provided with a central, upstanding rib 80 having lateral ribs 81 spaced therealong. Connecting ribs 82 are associated with the ribs 81 but are separated from the latter by gaps 83. The cover block has openings therein which overlie the gaps 83 and in each of which is mounted a plunger 84 having a conductive foot 85 which spans the associated gap. The ribs 80 and 82 may engage conductors 86 and 87, respectively, which may be wires or printed circuit conductors and which are connected to a battery B and to devices 88 to be operated.

When the pad 2*i* is compressed between the members 78 and 79, by means of screws 89 or spring clips (not shown), those portions of the pad 2*i* overlying the ribs 80, 81 and 82 will be compressed so as to be rendered conductive. Those portions of the pad 2*i* overlying the gaps 83 and the areas between the ribs will be relatively uncompressed, however, thereby establishing non-conductive zones in the pad. When a plunger 84 is depressed, the associated gap 83 will be bridged by the conductor 85 thereby establishing a conductive path across the gap. Upon release of the plunger, the inherent resilience of the pad 2*i* at the gap will displace the plunger and break the circuit. Bosses 90 may be provided adjacent the screws 89 to limit the force that may be applied to the pad 2i and to limit the degree to which the ribs may be embedded in the body, thereby avoiding any possibility that those portions thereof which overlie the gaps 83 will be compressed sufficiently to be conductive unless and until a plunger 84 is depressed.

It is not essential that the plungers 84 be provided. Any conductor, such as a metal disk or the like, can bridge the gaps 83 and be displaced in a direction to compress those portions of the body 2i which lie in the gaps. It is to be understood that either, or both, of the members 78 and 79 may be provided with the pressure ribs.

The invention makes possible the simplification of relatively complex wiring requirements such as that schematically illustrated in FIGS. 17 and 18 wherein a cover 92 of insulating material is provided with upstanding pressure ribs 93 and 94 spaced by a gap 95 through which extends a transverse pressure rib 96. In this instance it is desired to establish conductive paths along the ribs 93 and 94 and along the rib 96, but to isolate the paths from one another. This may be accomplished by sandwiching a body 2j, similar to the body 2, between the member 92 and a base member 97 and by cutting the body to form a strip 98 which underlies the rib 96. The ribs 93 and 94 are spanned by a conductor 99 and between the latter and the rib 96 is interposed an insulator 100. A conductive path thus may be established along the ribs 93 and 94 via the conductor 99 and a second conductive path may be established along the rib 96, but the conductive paths are isolated from one another by the insulator 100.

The invention also makes possible simplified joining of printed circuits to conventional wiring harnesses. FIG. 19 discloses a flexible sheet of non-conductive material 101 provided with flexible conductors 102. At any desired location a body 21 similar to the body 2 may be placed on the sheet 101 and the bare ends of wires 103 may be placed atop the body 21 in a position to overlie selected conductors 102. The assembly of the sheet 101, the body 21 and the wires 103 may be sandwiched between two nonconductive pressure bars 104 which are held together by screws 105 or spring clips (not shown). The wires 103 are forced into compressive engagement with the body 21 so as to compress the latter at the selected conductors 102 and establish conductive paths between the wires 103 and the conductors 102.

The disclosed embodiments are representative of presently forms of the invention, but are intended to be illustrative thereof. The invention is defined in the claims.

I claim:

1. In an electrical system comprising first and second electrical devices, each of said first and second electrical devices having a plurality of spaced apart contacts, at least one of said plurality of contacts comprising raised land portions, a one piece sheet connector having elastomericlike properties positioned between the devices and overlapping superimposed contacts of said first and second devices, means to compress the sheet connector between superimposed contacts of said first and second devices on opposite surfaces of said sheet connector, said sheet connector having a low resistance through the volume between superimposed contacts where compressed and a high resistance where not directly compressed between said superimposed contacts so that each pair of superimposed contacts are electrically isolated from every other pair of superimposed contacts, said sheet connector of a thickness X and has the property that when adjacent contacts on opposite sides of said sheet are positioned as close as the distance X apart and compression is applied by pressing superimposed contacts on opposite sides of the sheet together, the resistance through the sheet between superimposed contacts is low relative to the resistance between adjacent contacts, where X is 5 to 100 mils and said sheet connector comprises a homogeneous mixture of electrically conductive particles and a nonconductive binder material having elastomeric properties.

2. In a system according to claim 1 in which the resistance through the volume where compressed between superimposed contacts is less than 10 ohms and wherein the resistance through the volume which is not directly compressed between superimposed contacts is greater than $10^5$ ohms.

3. In a system according to claim 1 wherein the resistance between adjacent contacts compressively engaging the sheet is greater than $10^5$ ohms and wherein the resistance between superimposed contacts is less than 10 ohms.

4. In a system according to claim 1 wherein the sheet is of a thickness of 10 to 30 mils.

5. Pressure sensitive electrical apparatus comprising a body formed of electrically insulating elastomeric material throughout which discrete, electrically conductive particles are dispersed, the quantity and size of such particles being such that said body is electrically nonconductive when uncompressed and electrically conductive when compressed, the quantity and size of said particles being so proportioned to the thickness of said body as to provide the latter with the property that upon compression of said body at two zones spaced apart a distance equal to the thickness of said body a conductive path is established through said body at each of said zones while that part of said body between said zones remains non-conductive; a plurality of conductors at one side of said body and spaced from one another a distance corresponding to the spacing between said zones; correspondingly spaced conductive means at the opposite side of said body and aligned with said conductors; and means for compressing said body at said zones to establish a plurality of conductive paths through said body.

6. Apparatus according to claim 5 wherein said conductors comprise elements having portions thereof at least partially embedded in said body.

7. Apparatus according to claim 6 wherein said conductive means have portions thereof at least partially embedded in said body.

8. Pressure sensitive electrical apparatus comprising a body formed of electrically insulating elastomeric material throughout which discrete, electrically conductive metal particles are dispersed, the quantity and size of such particles being such that said body has a relatively high electrical resistance when uncompressed and a relatively low electrical resistance when compressed, the quantity and size of said particles being so proportioned to the thickness of said body as to provide the latter with the property that upon compression of said body at two zones spaced apart a distance equal to the thickness of said body a conductive path of relatively low resistance is established through said body at each of said zones while that part of said body between said zones retains its relatively high resistance.

9. Apparatus according to claim 8 wherein said body is non-conductive when uncompressed.

10. Apparatus according to claim 8 wherein said body when compressed has a resistance corresponding substantially to that of said particles.

11. Apparatus according to claim 8 wherein said particles are substantially spherical.

12. Apparatus according to claim 8 wherein said particles are composed of non-noble metal coated with a noble metal.

13. A device according to claim 8 wherein said particles are formed of a metal which when oxidized forms an electrically conductive oxide.

14. A device according to claim 31 wherein said particles are formed of non-noble metal coated with noble metal.

15. A device according to claim 8 including means for applying a compressive force on said body at each of said zones.

16. A device according to claim 15 wherein said force applying means comprises a plurality of aligned, electrically conductive members on opposite sides of said body and compressing the latter between them.

17. A device according to claim 15 wherein said force applying means comprises bearing members between which said body is sandwiched, at least one of said bearing members having upstanding rib means bearing against said body.

18. A device according to claim 17 wherein said rib means has a gap therein.

19. A device according to claim 18 including manipulatable means overlying said gap and operable to compress that portion of said body which spans said gap.

* * * * *

UNITED STATES PATENT AND TRADEMARK OFFICE

CERTIFICATE OF CORRECTION

PATENT NO. : 4,295,699

DATED : October 20, 1981

INVENTOR(S) : Gideon A. DuRocher

It is certified that error appears in the above-identified patent and that said Letters Patent are hereby corrected as shown below:

Column 4, line 33, change "ad" to -- as --.

Column 5, line 57, change "sandwhiched" to -- sandwiched --.

Column 8, line 40, change "cube" to -- tube --.

Signed and Sealed this

*Thirteenth* Day of *December 1983*

[SEAL]

*Attest:*

GERALD J. MOSSINGHOFF

*Attesting Officer*

*Commissioner of Patents and Trademarks*